US008735711B2

(12) United States Patent
Kuroki

(10) Patent No.: US 8,735,711 B2
(45) Date of Patent: May 27, 2014

(54) SIGNAL PROCESSING APPARATUS FOR STRINGED INSTRUMENT

(71) Applicant: Yamaha Corporation, Hamamatsu (JP)

(72) Inventor: Ryuichiro Kuroki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/777,954

(22) Filed: Feb. 26, 2013

(65) Prior Publication Data

US 2013/0233159 A1 Sep. 12, 2013

(30) Foreign Application Priority Data

Mar. 6, 2012 (JP) ..... 2012-48696

(51) Int. Cl.
*G10H 1/12* (2006.01)

(52) U.S. Cl.
USPC ..... 84/736

(58) Field of Classification Search
USPC ..... 84/736
See application file for complete search history.

(56) References Cited

U.S. PATENT DOCUMENTS

| | | | | |
|---|---|---|---|---|
| 6,627,808 | B1 | 9/2003 | Coats et al. | |
| 6,791,023 | B2 * | 9/2004 | Nakaya | 84/736 |
| 7,271,332 | B2 * | 9/2007 | Clark | 84/736 |
| 7,982,125 | B2 * | 7/2011 | Takabayashi et al. | 84/731 |
| 2003/0094094 | A1 | 5/2003 | Nakaya | |
| 2011/0226118 | A1 | 9/2011 | Kuroki | |

FOREIGN PATENT DOCUMENTS

| | | | |
|---|---|---|---|
| EP | 2077549 | A1 | 7/2009 |
| EP | 2372692 | A2 | 10/2011 |
| JP | 2011-197325 | A | 10/2011 |
| WO | WO-2005-001811 | A1 | 1/2005 |
| WO | WO-2011-003148 | A1 | 1/2011 |

OTHER PUBLICATIONS

European Search Report dated Aug. 20, 2013, for EP Application No. 13154313.4, 13 pages.

* cited by examiner

*Primary Examiner* — Jeffrey Donels
(74) *Attorney, Agent, or Firm* — Morrison & Foerster LLP

(57) ABSTRACT

A signal processing apparatus 30 includes a FIR filter 33 that generates a signal corresponding to an instrument sound including a resonance of a body caused by a vibration of a string, based upon a pickup signal from a pickup sensor 21. The signal processing apparatus 30 guides the pickup signal from the pickup sensor 21 to an adder circuit 35 via a low-pass filter 32, guides the signal generated by the FIR filter 33 to the adder circuit 35 via a high-pass filter, and adds and mixes these signals in the adder circuit 35. The cut-off frequency of the high-pass filter 34 is equal to or higher than the cut-off frequency of the low-pass filter 32.

16 Claims, 8 Drawing Sheets

SIGNAL PROCESSING APPARATUS FOR STRINGED INSTRUMENT

BACKGROUND OF THE INVENTION

1. Field of the Invention

The present invention relates to a signal processing apparatus for a stringed instrument, the apparatus mixing a signal acquired by picking up a vibration of a string, and a signal corresponding to an instrument sound including a resonance of a body caused by the vibration of the string.

2. Description of the Related Art

When a player plays an acoustic guitar, its volume is limited. Therefore, when the player plays an acoustic guitar live in a big hall, sound is collected and amplified by use of a microphone to increase volume. When there is the other instrument near the acoustic guitar, the sound of the other instrument might be picked up, or acoustic feedback might be caused in this method. In order to prevent this situation, a pickup sensor composed of a piezoelectric element is mounted to a saddle supporting a string for converting the vibration of the string into an electric signal, and the electric signal is amplified to increase volume.

The electric signal (pickup signal) corresponding to the vibration of the string can be acquired by mounting the pickup sensor to the saddle. However, the pickup signal includes few components involved with a resonance of a body called "box resonance". Therefore, as described in Japanese Unexamined Patent Publication No. 2011-197325 and illustrated in FIG. 11, there has conventionally been known a technique in which a pickup signal mainly corresponding to a vibration of a string and picked up by a pickup sensor 1, mounted to a saddle supporting the string, is fed to an adder 2, the pickup signal picked up by the pickup sensor 1 is fed to the adder 2 via a FIR (Finite Impulse Response) filter 3 that is used to add a resonance component of a body, the fed two signals are mixed by the adder 2 to complement the resonance component of the body that is reduced, and the resultant is outputted. In this case, the FIR filter 3 performs a convolution operation to the input signal to simulate the resonance caused by the resonance of the body of the stringed instrument, thereby generating an instrument sound signal sufficiently including the resonance component. Accordingly, the signal mainly corresponding to the vibration of the string of the stringed instrument and the signal corresponding to the instrument sound signal sufficiently including the body resonance caused by the vibration of the string are mixed, whereby a stringed instrument sound satisfactorily reflecting the body resonance in addition to the string vibration is outputted.

SUMMARY OF THE INVENTION

However, the present inventor has found that, in the signal processing described in the background art, phase interference is caused between two signals that are to be mixed, resulting in that low-frequency volume of the mixed signal is decreased. This will be described with reference to a frequency characteristic view in FIG. 12. FIG. 12A illustrates a frequency characteristic of the signal corresponding to a string vibration picked up by the pickup sensor 1, FIG. 12B illustrates a frequency characteristic of the signal corresponding to the instrument sound including a body resonance generated by the FIR filter 3, and FIG. 12C illustrates a frequency characteristic of a mixed signal formed by mixing these two signals. In this case, the gain of the signal component in a range of about 100 to 200 Hz in FIG. 12B reduces, so that a portion indicated by an arrow A in FIG. 12C is formed. This is estimated to be caused by phase interference due to a phase shift generated between the signal directly from the pickup sensor 1 and the signal via the FIR filter 3. As a result, the instrument sound by the mixed signal might be unnatural, different from the instrument sound generated from the stringed instrument.

The present invention is accomplished in view of the above-mentioned problem, and aims to eliminate unnaturalness in a generated instrument sound in a signal processing apparatus for a stringed instrument that generates an instrument sound reflecting not only the string vibration but also a body resonance, by mixing a signal acquired by picking up a string vibration and a signal corresponding to an instrument sound including the body resonance caused by the string vibration. For easy understanding of the present invention, a numeral of a corresponding portion in an embodiment is written in a parenthesis in the description below of each constituent of the present invention. However, each constituent of the present invention should not be construed as being limited to the corresponding portion indicated by the numeral in the embodiment.

In order to attain the foregoing object, a signal processing apparatus according to the present invention includes: a low-pass filter (32) that receives either one of a first signal acquired by picking up a vibration of a string (5) and a second signal corresponding to an instrument sound including resonance of a body (11) due to the vibration of the string; a high-pass filter (34) that receives the other one of the first signal and the second signal, and that has a cut-off frequency equal to or higher than a cut-off frequency of the low-pass filter; and a mixing unit (35) that mixes the output from the low-pass filter and the output from the high-pass filter, and outputs the resultant. In this case, it is only necessary that the cut-off frequency of the high-pass filter is equal to or higher than the cut-off frequency of the low-pass filter, but it is desirable that the cut-off frequency of the high-pass filter and the cut-off frequency of the low-pass filter are equal to each other. When the cut-off frequency of the high-pass filter is higher than the cut-off frequency of the low-pass filter, the difference between both cut-off frequencies is set to be a small predetermined value.

In the present invention thus configured, the first signal and the second signal are outputted as being mixed. Therefore, even if the first signal acquired by picking up the vibration of the string includes less body resonance, the instrument sound signal including the body resonance caused by the vibration of the string is generated. The band of the signal passing through the low-pass filter and the band of the signal passing through the high-pass filter are distinguished. Therefore, phase interference is not caused between the first and second signals, whereby the reduction in low-frequency volume in the mixed signal is prevented. Accordingly, the instrument sound by the mixed signal becomes natural. If the cut-off frequency of the high-pass filter and the cut-off frequency of the low-pass filter are set to be equal to each other, the first signal and the second signal can uniformly be mixed in all frequency bands.

Another aspect of the present invention is that the signal processing apparatus includes a change control unit (37) that simultaneously changes the cut-off frequency of the low-pass filter and the cut-off frequency of the high-pass filter. In this case, the change control unit simultaneously changes the cut-off frequency of the low-pass filter and the cut-off frequency of the high-pass filter according to an operation on an operation unit (41). The instrument sound signal having different characteristics between the instrument sound signal including few resonance components due to the body resonance and the instrument sound signal including many resonance components due to the body resonance is generated by the change control unit. As a result, the instrument sound signal having a frequency characteristic according to a favor of a performer, and a change in a situation can be generated according to another aspect of the present invention.

Another aspect of the present invention is that the low-pass filter receives the first signal, and the high-pass filter receives the second signal. With this configuration, only the low-frequency component of the first signal that is picked up is extracted, and a large amount of annoying high-frequency components included in the picked-up first signal is cut. Accordingly, the instrument sound signal is not annoying.

Another aspect of the present invention is that the first signal is a signal picked up by a vibration sensor (21) mounted near a saddle supporting the string, and the second signal is a signal generated by a filter circuit (33) that performs a convolution operation to the first signal. With this configuration, the resonance caused by the body resonance of the stringed instrument is simulated by performing the convolution operation to the first signal by the filter circuit, whereby the instrument sound signal sufficiently including the resonance component can easily be generated.

Another aspect of the present invention is that the first signal is a signal picked up by a first vibration sensor (21) mounted near a saddle supporting the string, and the second signal is a signal picked up by a second vibration sensor (22) mounted to the body, or a signal acquired by a microphone (23, 24) mounted near the body. According to this configuration, the instrument sound signal can easily be generated by utilizing the vibration sensor or the microphone that is popularly used, without preparing a special circuit, such as the filter circuit, which simulates the body resonance through the convolution operation.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT a. Example of Basic Configuration

A signal processing apparatus for a stringed instrument according to one embodiment of the present invention will be described below. Firstly, an example of a basic configuration of the signal processing apparatus will be described.

Figure 1:
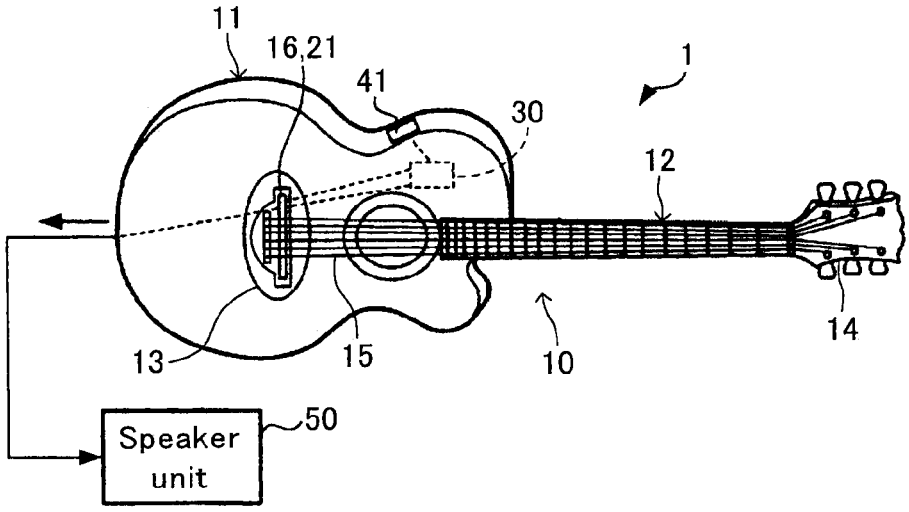
FIG. 1 is a view illustrating an appearance of a guitar according to an embodiment of the present invention.

FIG. 1 is a view illustrating an appearance of a guitar (electric acoustic guitar) 10 according to an embodiment of the present invention. The guitar 10 includes a body 11 and a neck 12, and further includes plural strings 15 extending between a bridge 13 fixed on the top surface of the body 11 and a head 14 formed at the upper part of the neck 12. The strings 15 are supported by a saddle 16 formed on the bridge 13 (or on the top surface of the body 11).

The guitar 10 also includes a pickup sensor 21, a signal processing apparatus 30, and an operation unit 41. The pickup sensor 21 is a vibration sensor that is arranged between the bridge 13 (or the body 11) and the saddle 16, and that is composed of a piezoelectric element. The pickup sensor 21 picks up the vibration of the strings 15, and outputs an electric signal (pickup signal) indicating the vibration of the strings 15. An element other than the piezoelectric element can be used for the pickup sensor 21, so long as it can pick up the vibration of the strings 15 and convert the vibration into an electric signal. The pickup sensor 21 is not necessarily arranged between the body 11 and the saddle 16. It may be fixed near the saddle 16, e.g., on the surface of the saddle 16. The pickup sensor 21 is not necessarily composed of the piezoelectric element. A pickup coil may be used for the pickup sensor 21, so long as it can mainly pick up the vibration of the strings 15.

The signal processing apparatus 30 is arranged in the body 11. It receives the pickup signal from the pickup sensor 21 and an operation signal from the operation unit 41, operates in accordance with the operation signal from the operation unit 41, processes the pickup signal, and outputs the resultant to a speaker unit 50. The signal processing apparatus 30 will be described later in detail. The operation unit 41 is provided on the side face of the body 11, and includes a rotary switch and operation button operated by a performer. The speaker unit 50 includes an amplifier and a speaker. It converts the instrument sound signal outputted from the signal processing apparatus 30 into an acoustic signal, and emits the acoustic signal to the outside. The signal processing apparatus 30 and the operation unit 41 may be provided on the body 11, i.e., provided at the outside of the guitar 10.

Figure 2:
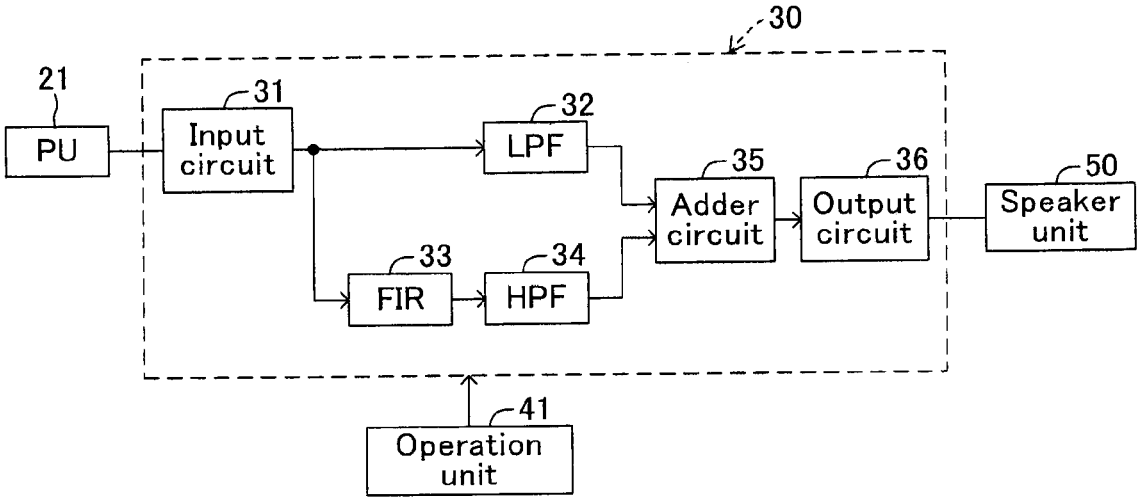
FIG. 2 is a circuit diagram of a signal processing apparatus in FIG. 1 involved with an example of a basic configuration according to the embodiment of the present invention.
Figure 3A:
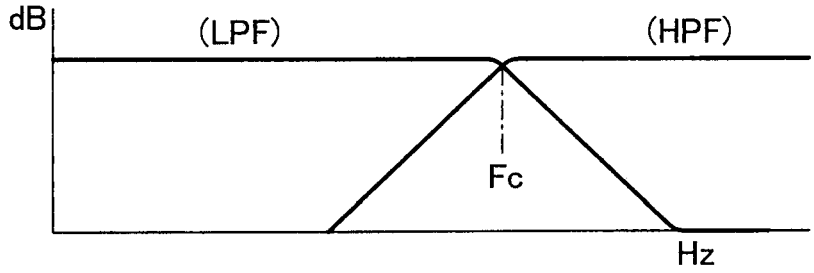
FIG. 3A is a frequency characteristic view of a low-pass filter (LPF) and a high-pass filter (HPF) in FIG. 2.

As illustrated in FIG. 2, the signal processing apparatus 30 includes an input circuit 31. The input circuit 31 amplifies the pickup signal, which is an analog signal, from the pickup sensor 21 as needed, performs an A/D conversion, and outputs the resultant. A low-pass filter 32 (hereinafter merely referred to as LPF 32) is connected to the input circuit 31, and a series circuit of a finite impulse response filter 33 (hereinafter merely referred to as FIR filter 33) and a high-pass filter 34 is connected to the input circuit 31. As illustrated in FIG. 3A, the LPF 32 has a frequency characteristic of a flat gain on a low frequency area equal to or lower than a cut-off frequency Fc.

Figure 3B:
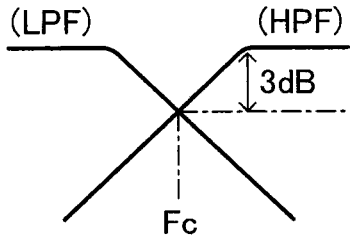
FIG. 3B is a frequency characteristic view illustrating a cut-off frequency Fc in FIG. 3A as enlarged.

The FIR filter 33 performs a convolution operation to the input signal from the pickup sensor 21 so as to add a resonance component, which is caused by a resonance of the body 11, and which is insufficient in the pickup signal from the pickup sensor 21, to the pickup signal. With this, the FIR filter 33 generates the instrument sound signal sufficiently including the resonance component. As illustrated in FIG. 3A, the HPF 34 has a frequency characteristic of a flat gain on a high frequency area equal to or higher than the cut-off frequency Fc. In this case, the cut-off frequency Fc of the LPF 32 and the cut-off frequency Fc of the HPF 34 are equal to each other. Correctly, the frequency corresponding to the position lower than the maximum value of the flat gain of the LPF 32 by 3 dB and the frequency corresponding to the position lower than the maximum value of the flat gain of the HPF 34 by 3 dB are equal to each other as illustrated in FIG. 3B in which the area including the cut-off frequency Fc is enlarged.

An adder circuit 35 is connected to the LPF 32 and the HPF 34. The adder circuit 35 adds and mixes the output signals from the LPF 32 and the HPF 34, and outputs the resultant to an output circuit 36. The output circuit 36 executes a D/A conversion to the mixed signal, and outputs the resultant to the speaker unit 50.

Figure 4A:
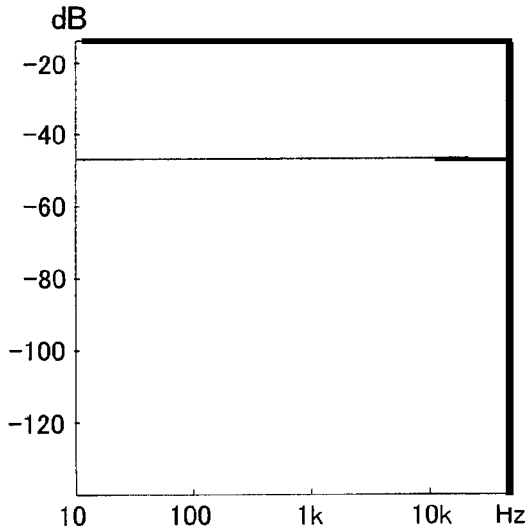
FIGS. 4A to 4C are views illustrating a frequency characteristic of a signal by the signal processing apparatus involved with the example of the basic configuration.
Figure 4B:
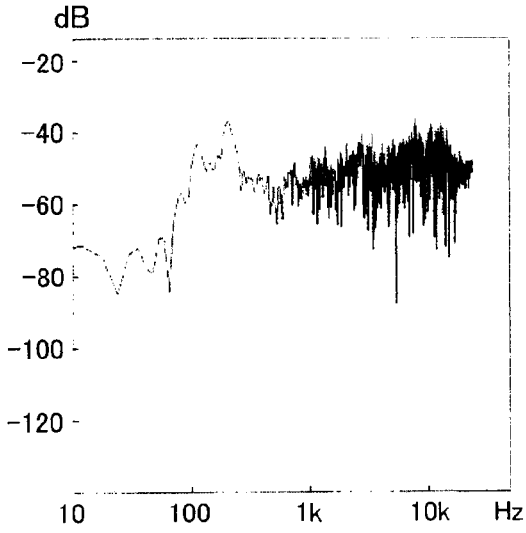

In the example of the basic configuration thus configured, when the string 15 vibrates by a performer, the vibration of the string 15 is converted into the pickup signal by the pickup sensor 21, and the converted pickup signal is fed to the LPF 32, and the FIR filter 33 and the HPF 34 that are connected in series, via the input circuit 31. FIG. 4A illustrates the frequency characteristic of the pickup signal. The LPF 32 outputs only the low-frequency component of the pickup signal equal to or lower than the cut-off frequency Fc to the adder circuit 35. On the other hand, the FIR filter 33 generates a signal not only including the component corresponding to the vibration of the string 15 but also sufficiently including the resonance component caused by resonance of the body 11. FIG. 4B illustrates the frequency characteristic of the signal sufficiently including the resonance component. The HPF 34 outputs only the high-frequency component, equal to or higher than the cut-off frequency Fc, of the signal, sufficiently including the resonance component caused by the resonance of the body 11, from the FIR filter 33 to the adder circuit 35.

Figure 4C:
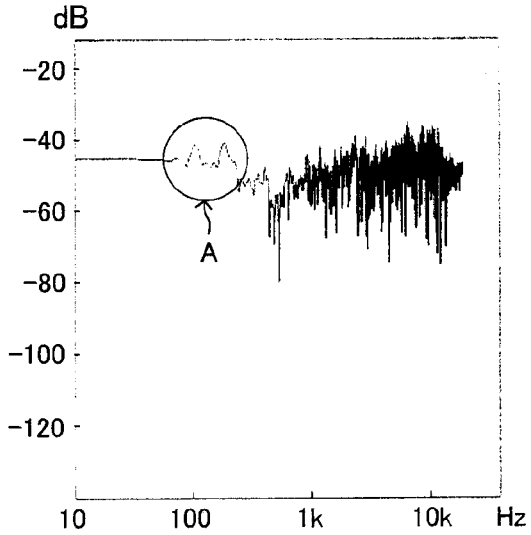

The adder circuit 35 adds and mixes the output signals from the LPF 32 and the HPF 34, and outputs the mixed signal to the output circuit 36. FIG. 4C illustrates the frequency characteristic of the mixed signal. It is found from the frequency characteristic in FIG. 4C that the low-frequency component of the mixed signal, particularly the component near 100 to 200 Hz, is sufficiently left as in the distribution characteristic of the resonance component, caused by the resonance of the body 11, illustrated in the frequency characteristic in FIG. 4B (see an arrow A). The output circuit 36 executes a D/A conversion to the mixed signal, and outputs the resultant to the speaker unit 50. The ratio of the mixture of the output signal from the LPF 32 and the output signal from the HPF 34 is adjusted by adjusting the position of the cut-off frequency Fc. In the frequency characteristic in FIG. 4C, the ratio of the mixture of the output signal from the LPF 32 and the output signal from the HPF 34 is 4 to 6. The speaker unit 50 amplifies the mixed signal from the output circuit 36, as needed, converts the mixed signal into an acoustic signal, and emits the resultant.

In the example of the basic configuration operated as described above, the output signal from the LPF 32 and the output signal from the HPF 34 have a different frequency band. Therefore, phase interference is not caused between both signals, whereby the reduction in volume of the low-frequency component, particularly the reduction in the component near 100 to 200 Hz, due to the phase interference can be prevented. Consequently, according to the example of the basic configuration, the instrument sound generated by the mixed signal becomes similar to the instrument sound actually generated from the stringed instrument, whereby the generation of unnatural instrument sound can be prevented, and the instrument sound to be outputted can be satisfactory.

In the example of the basic configuration operated as described above, the pickup signal from the pickup sensor 21 is outputted via the LPF 32 in order to extract only the low-frequency component of the pickup signal. Thus, many annoying high-frequency components, included in the pickup signal, are cut, and with this state, the pickup signal is outputted. Therefore, the instrument sound is comfortable. Since the pickup signal outputted in this case does not undergo an electric processing by the FIR filter 33, a powerful rich sound by the low-frequency component can be realized.

In the example of the basic configuration as described above, the instrument sound signal including the resonance of the body 11 is generated by the FIR filter 33, which performs the convolution operation, based upon the pickup signal from the pickup sensor 21. By the convolution operation to the pickup signal by the FIR filter 33 as described above, the resonance caused by the resonance of the body 11 of the guitar 10 is simulated, so that the instrument sound signal sufficiently including the resonance component can easily be generated.

Figure 3C:
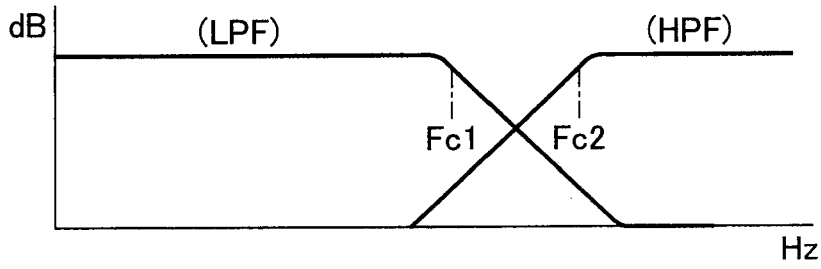
FIG. 3C is a frequency characteristic view of a low-pass filter (LPF) and a high-pass filter (HPF) according to another example.

In the example of the basic configuration as described above, the output signals from the LPF 32 and the HPF 34 are mixed with the cut-off frequency Fc of the LPF 32 and the cut-off frequency Fc of the HPF 34 being equal to each other. However, instead of this configuration, a cut-off frequency Fc1 of the LPF 32 and a cut-off frequency Fc2 of the HPF 34 may be separated from each other, i.e., the cut-off frequency Fc2 of the HPF 34 may be higher than the cut-off frequency Fc1 of the LPF 32 as illustrated in FIG. 3C. According to this configuration, phase interference is not caused between the output signal from the LPF 32 and the output signal from the HPF 34 as described above, which can prevent the instrument sound signal by the mixed signal from being unnatural. Accordingly, the outputted instrument sound signal can be satisfactory. When the cut-off frequency Fc1 of the LPF 32 and the cut-off frequency Fc2 of the HPF 34 are greatly separated from each other, a large band where the signal is not outputted is generated between the cut-off frequencies Fc1 and Fc2. Therefore, the difference between both cut-off frequencies has to be set to be small to some extent. Specifically, in the relationship between the LPF 32 and the HPF 34, the cut-off frequency Fc2 of the HPF 34 is higher than the cut-off frequency Fc1 of the LPF 32, and the difference between both cut-off frequencies Fc1 and Fc2 is kept to be a small predetermined value set beforehand. In this case, the effect of avoiding the annoying sound and the effect of realizing a powerful sound can also be expected by inputting the pickup signal from the pickup sensor 21 to the LPF 32.

The LPF 32 and the HPF 34 may be replaced with each other, if the problem of a large number of annoying high-frequency components included in the pickup signal can be negligible, or if the annoying high-frequency component does not have to be regarded as a problem, and the effect of powerful sound is not expected so much. Specifically, the output signal from the input circuit 31 may be guided to the adder circuit 35 via the HPF 34, and the output from the FIR filter 33 may be outputted to the adder circuit 35 via the LPF 32. According to this configuration, the phase interference is not caused between the output signals from the LPF 32 and the HPF 34, so that the problem of the reduction in volume of the low-frequency component due to the phase interference is solved. Accordingly, the instrument sound signal becomes similar to the instrument sound actually generated from the stringed instrument, which means the generation of the unnatural instrument sound can be prevented. Consequently, the outputted instrument sound can be satisfactory.

In the signal processing apparatus illustrated in FIG. 2, the order of the connection of the FIR filter 33 and the HPF 34 may be reversed. Specifically, the signal may be guided to the HPF 34 from the input circuit 31, and the output from the HPF 34 may be guided to the adder circuit 35 via an RIR filter 33. Further, in the modification in which the output signal from the input circuit 31 is guided to the adder circuit 35 via the HPF 34, and the output from the FIR filter 33 is outputted to the adder circuit 35 via the LPF 32, the signal may be guided to the LPF 32 from the input circuit 31, and the output from the LPF 32 may be guided to the adder circuit 35 via the FIR filter 33.

In the example of the basic configuration as described above, the LPF 32, the FIR filter 33, the HPF 34, and the adder circuit 35 are composed of an independent digital circuit. However, the functions of the LPF 32, the FIR filter 33, the HPF 34, and the adder circuit 35 may be realized by a software process by use of a digital processing circuit such as DSP (Digital Signal Processor). The LPF 32, the FIR filter 33, the HPF 34, and the adder circuit 35 may respectively be composed of an analog circuit. In this case, the A/D conversion by the input circuit 31 and the D/A conversion by the output circuit 36 are unnecessary.

The various modifications in the example of the basic configuration described above are applied to a specific embodiment and its modification described later.

b. Specific Embodiment

Figure 5:
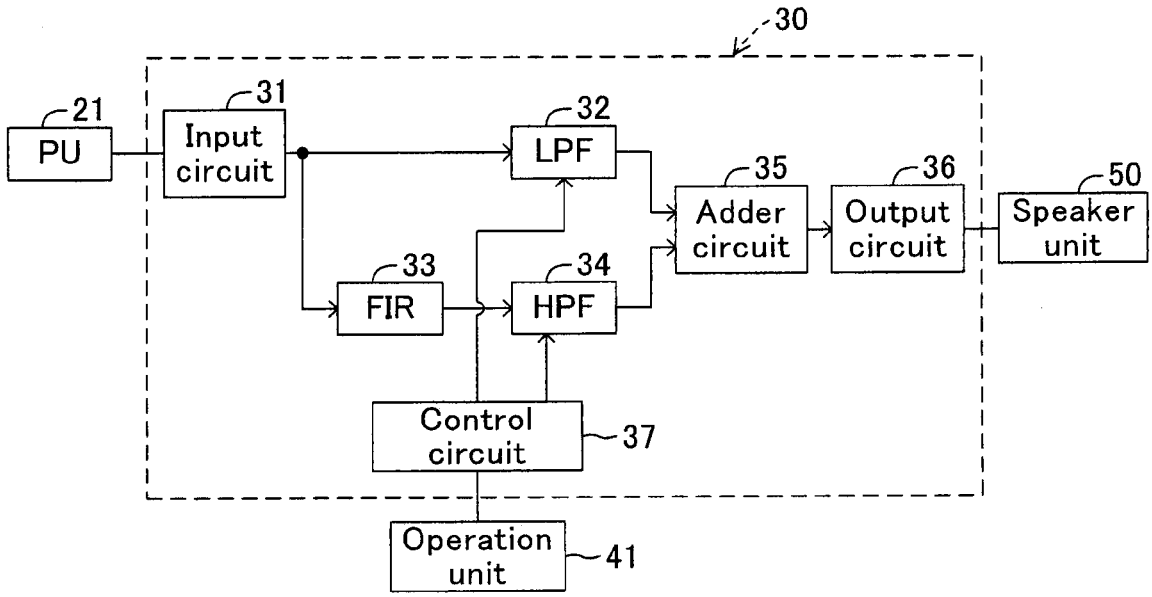
FIG. 5 is a circuit block diagram of the signal processing apparatus according to a specific embodiment of the present invention.

A specific embodiment of the present invention will next be described. FIG. 5 illustrates a circuit block of a signal processing apparatus 30 according to the specific embodiment of the present invention. In the specific embodiment, the signal processing apparatus 30 includes a control circuit 37. The other configuration is the same as that of the example of the basic configuration illustrated in FIG. 2, so that the same components are identified by the same numerals, and the description thereof will not be repeated.

The control circuit 37 controls to simultaneously and continuously change the cut-off frequencies Fc of the LPF 32 and the HPF 34 within a predetermined frequency range, i.e., within 20 Hz to 20 KHz, according to an operation on the operation unit 41 by the performer. The LPF 32 and the HPF 34 continuously and simultaneously change their same cut-off frequency Fc within the predetermined frequency range under the control of the control circuit 37. The cut-off frequency Fc of the LPF 32 and the cut-off frequency Fc of the HPF 34 are kept to be equal to each other during when the cut-off frequencies Fc are continuously changed.

Figure 6:
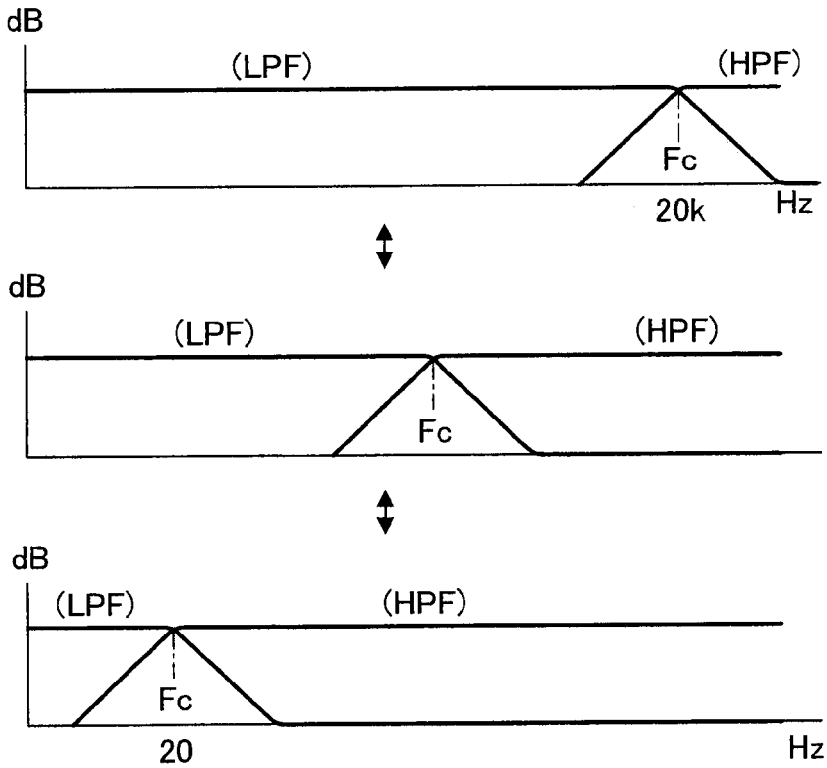
FIG. 6 is an explanatory view for describing changed cut-off frequencies of the LPF and the HPF in FIG. 5.

The upper chart in FIG. 6 illustrates the case where the cut-off frequencies of the LPF 32 and the HPF 34 are set to 20 KHz. In this case, the signal mixed in the adder circuit 35 becomes the instrument sound signal composed only of the output signal from the LPF 32, i.e., the pickup signal from the pickup sensor 21. The lower chart in FIG. 6 illustrates the case where the cut-off frequencies of the LPF 32 and the HPF 34 are set to 20 Hz. In this case, the signal mixed in the adder circuit 35 becomes the instrument sound signal composed only of the output signal from the HPF 34, i.e., only the signal including the resonance component caused by the resonance of the body 11 and generated from the FIR filter 33. The middle chart in FIG. 6 illustrates the case where the cut-off frequencies of the LPF 32 and the HPF 34 are set to be a predetermined value between 20 Hz and 20 KHz in order that the ratio of the mixture of the output signal from the LPF 32 and the output signal from the HPF 34 becomes 5 to 5.

Figure 7:
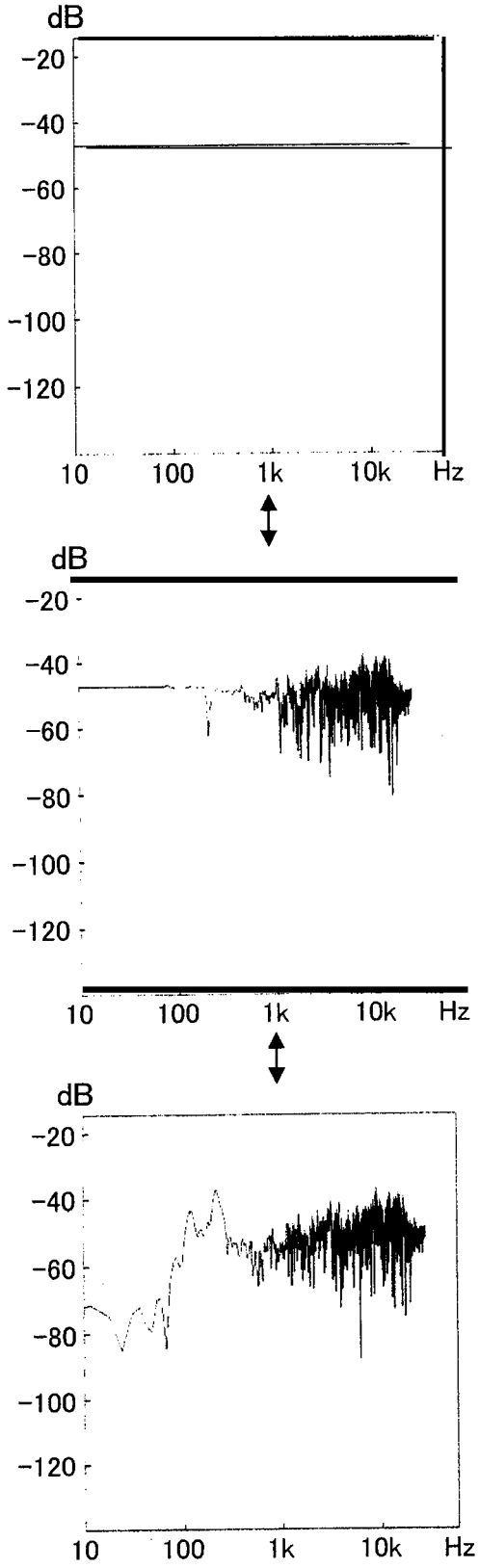
FIG. 7 is a view illustrating a frequency characteristic of a mixed instrument sound signal corresponding to the change in the cut-off frequency in FIG. 6.

In the specific embodiment, the instrument sound signal formed by mixing the instrument sound signal composed only of the pickup signal from the pickup sensor 21 and the instrument sound signal composed only of the signal including the resonance component caused by the resonance of the body 11 in an arbitrary ratio between both instrument sound signals can be generated and outputted according to the continuous change in the cut-off frequencies Fc of the LPF 32 and the HPF 34. FIG. 7 illustrates the change in the frequency characteristic of the instrument sound signal set according to the change in the cut-off frequencies Fc in FIG. 6.

According to the signal processing apparatus 30 in the specific embodiment, various instrument sounds between the instrument sound including only the pickup signal from the pickup sensor 21, i.e., the instrument sound including few resonance components by the resonance of the body 11, and the instrument sound generated by the FIR filter 33, i.e., the instrument sound sufficiently including the resonance component by the resonance of the body 11 can be emitted from the speaker unit 50 according to a favor of the performer and the change in the situation. As a result, the effect of generating the instrument sound having any frequency characteristic by the performer can be expected in addition to the effect described in the example of the basic configuration.

The continuous change of the cut-off frequency can be applied to the case where the cut-off frequency Fc1 of the LPF 32 and the cut-off frequency Fc2 of the HPF 34 are separated as described in the example of the basic configuration. In this case, the LPF 32 and the HPF 34 simultaneously and continuously change their cut-off frequencies Fc1 and Fc2 as keeping the difference between the cut-off frequencies Fc1 and Fc2 constant, under the control of the control circuit 37 according to the operation on the operation unit 41. According to this modification, the performer can also generate the instrument sound having any frequency characteristic as described above.

In the specific embodiment, the cut-off frequencies Fc of the LPF 32 and the HPF 34, or the cut-off frequency Fc1 of the LPF 32 and the cut-off frequency Fc2 of the HPF 34 are simultaneously and continuously changed according to the operation on the operation unit 41. However, instead of this, the cut-off frequencies Fc of the LPF 32 and the HPF 34, or the cut-off frequency Fc1 of the LPF 32 and the cut-off frequency Fc2 of the HPF 34 may be simultaneously changed in a stepwise manner according to the operation on the operation unit 41. Specifically, the cut-off frequencies Fc of the LPF 32 and the HPF 34, or the cut-off frequency Fc1 of the LPF 32 and the cut-off frequency Fc2 of the HPF 34 may be changed at intervals of a predetermined frequency according to the operation on the operation unit 41. In this case, an operation member on the operation unit 41 for instructing the change in the frequency may be a changeover switch having predetermined number of levels. According to this configuration, the performer can also generate the instrument sound having different frequency characteristics.

c. Modification

Figure 8:
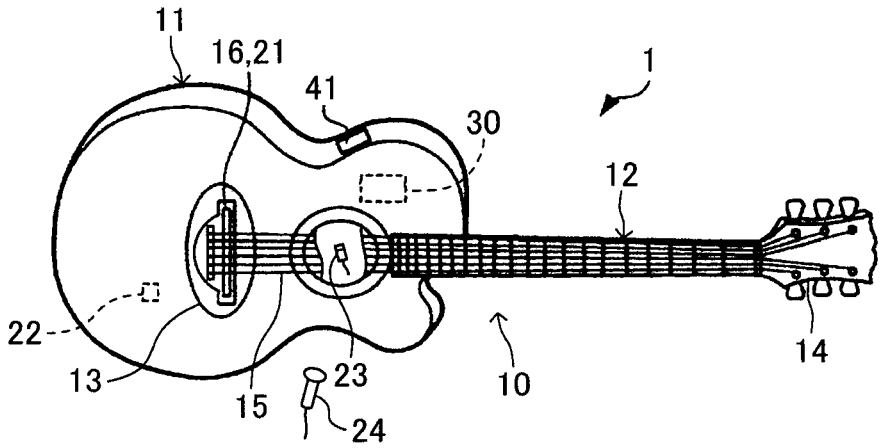
FIG. 8 is a view illustrating an appearance of a guitar according to a modification of the present invention.

In the example of the basic configuration and in the specific embodiment, the FIR filter 33 generates the instrument sound sufficiently including the resonance component due to the resonance of the body 11. However, instead of the FIR filter 33, a pickup sensor (vibration sensor) 22, a microphone 23, or a microphone 24 can be utilized as illustrated in FIG. 8 that illustrates an appearance of the guitar. In this modification, the other configuration is the same as the guitar 10 illustrated in FIG. 1, so that the same components are identified by the same numerals, and the description thereof will not be repeated.

The pickup sensor 22 is provided on an inner surface (back surface) of a front plate of the body 11. It detects the vibration of the body 11, and outputs the instrument sound signal sufficiently including the resonance component due to the resonance of the body 11. In this case, a piezoelectric sensor can be used as the pickup sensor 22. The microphone 23 is arranged in the body 11. It detects air vibration in the body 11, and outputs the instrument sound signal sufficiently including the resonance component due to the resonance of the body 11. In this case, a compact condenser microphone is suitable for the microphone 23. However, other microphones can be used. The microphone 24 is arranged at the outside of the body 11, i.e., at the outside of the guitar 10. It detects air vibration at the outside of the body 11, and outputs the instrument sound signal sufficiently including the resonance component due to the resonance of the body 11.

Figure 9:
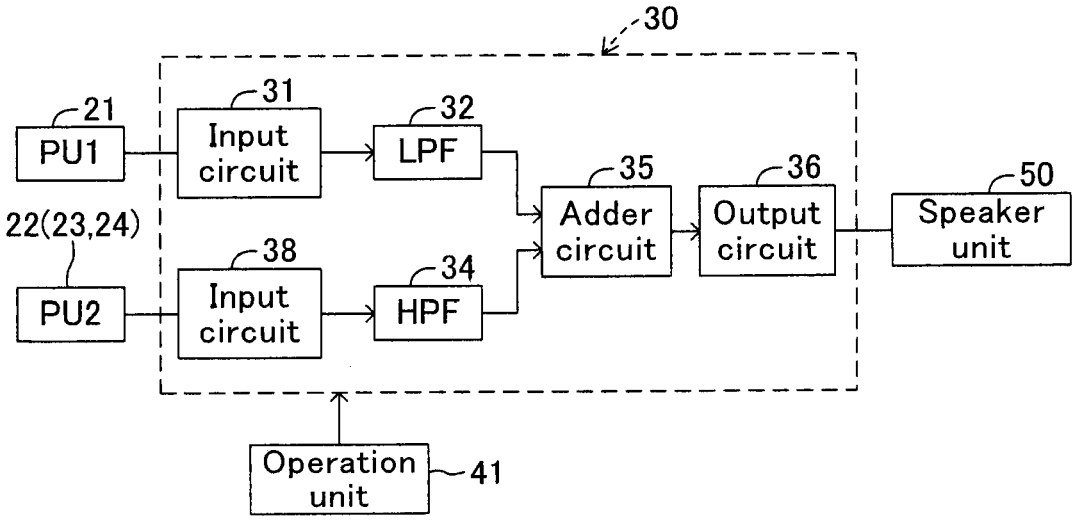
FIG. 9 is a circuit block diagram of a signal processing apparatus, when the guitar according to the modification is applied to the example of the basic configuration.
Figure 10:
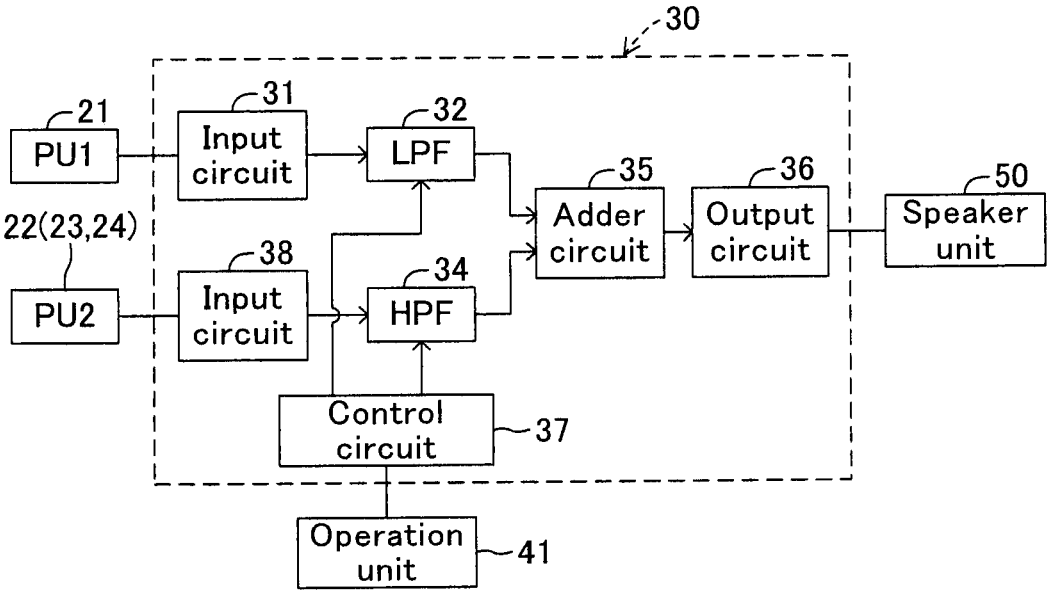
FIG. 10 is a circuit block diagram of the signal processing apparatus, when the guitar according to the modification is applied to the specific embodiment.
Figure 11:
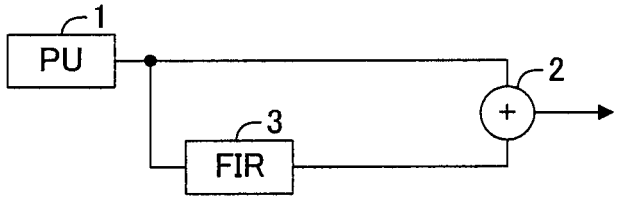
FIG. 11 is a schematic block diagram illustrating a conventional signal processing apparatus for a stringed instrument.
Figure 12A:
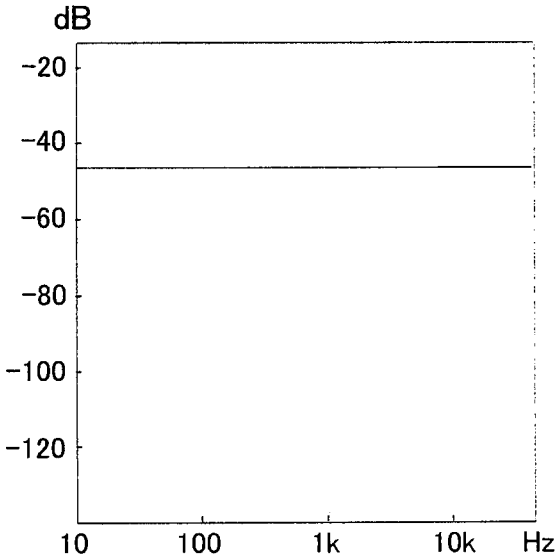
FIGS. 12A to 12C are views illustrating a frequency characteristic of a signal by the conventional signal processing apparatus.
Figure 12B:
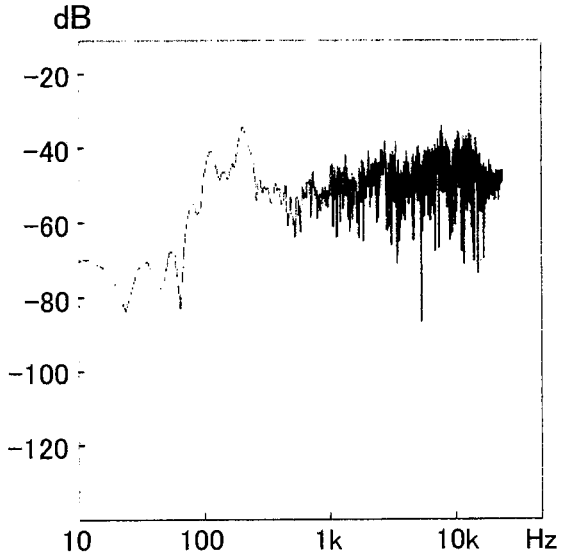
Figure 12C:
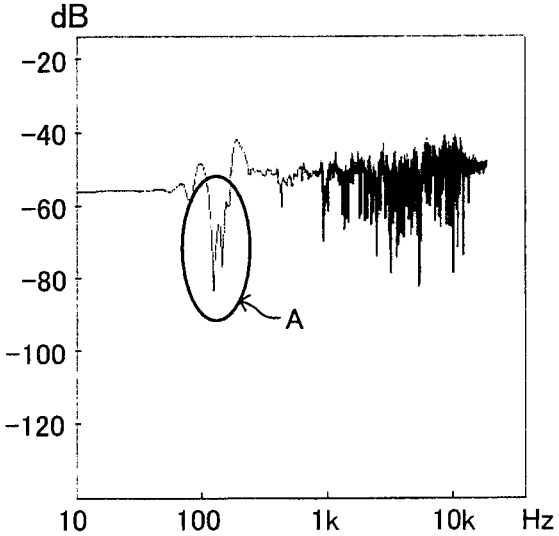

The signal processing apparatus 30 according to this modification will next be described. FIG. 9 is a circuit block diagram of the signal processing apparatus 30 in which the pickup sensor 22, the microphone 23, or the microphone 24 is applied to the example of the basic configuration illustrated in FIG. 2. FIG. 10 is a circuit block diagram of the signal processing apparatus 30 in which the pickup sensor 22, the microphone 23, or the microphone 24 is applied to the specific embodiment illustrated in FIG. 5. In FIGS. 9 and 10, the pickup sensor 21 in the example of the basic configuration and the specific embodiment is indicated as "PU1", and the pickup sensor 22, the microphone 23, or the microphone 24 in the modification is indicated as "PU2".

The signal processing apparatus 30 according to the modification in FIGS. 9 and 10 includes an input circuit 38. The input circuit 38 has the structure same as that of the input circuit 31. The input circuit 38 appropriately amplifies an input signal, performs an A/D conversion to the input signal, and outputs the resultant to the HPF 24. The other configuration of the signal processing apparatus 30 illustrated in FIGS. 9 and 10 is the same as the signal processing apparatus 30 in the example of the basic configuration in FIG. 2 and the signal processing apparatus 30 in the specific embodiment in FIG. 5. Therefore, the same components are identified by the same numerals, and the description thereof will not be repeated. In this case, the A/D conversion in the input circuit 38 is also unnecessary, when the LPF 32, the HPF 34 and the adder circuit 35 are composed of an analog circuit.

In the signal processing apparatus 30 thus configured according to the modification, the signal sufficiently including the resonance component caused by the resonance of the body 11 is also fed to the HPF 34, like the signal generated by the FIR filter 33 in the example of the basic configuration and in the specific embodiment. Therefore, in this modification, the pickup signal detected by the pickup sensor 21 is also fed to the LPF 32, and the signal picked up by the pickup sensor 22, the microphone 23, or the microphone 24 and sufficiently including the resonance component caused by the resonance of the body 11 is fed to the HPF 34, as in the example of the basic configuration and in the specific embodiment. Consequently, the effect same as that provided by the example of the basic configuration and in the specific embodiment can also be expected according to the modification.

In this modification, the instrument sound signal can easily be generated by utilizing the pickup sensor 22, the microphone 23, or the microphone 24, which is popularly used, without preparing a special circuit such as the FIR filter 33 that simulates the resonance of the body through the convolution operation described above.

In the modification illustrated in FIGS. 9 and 10, the signal inputted through the input circuit 38 from the pickup sensor 22, the microphone 23, or the microphone 24 may be processed in the FIR filter, and the resultant may be outputted to the adder circuit 35 through the LPF 32, without providing the pickup sensor 21 and the input circuit 31. In this case, the order of the FIR filter and the LPF 32 may be reversed, wherein the output from the LPF 32 may be outputted to the adder circuit 35 after being processed by the FIR filter. In addition, the signal inputted from the pickup sensor 22, the microphone 23, or the microphone 24 via the input circuit 38 may directly be outputted to the adder circuit 35 via the LPF 32, and the FIR filter may be provided before or after the HPF 34 in order to process the signal of the HPF 34 by the FIR filter.

Upon embodying the present invention, the present invention is not limited to the example of the basic configuration, the specific embodiment, and the modifications, and various alterations are possible without departing from the scope of the present invention.

What is claimed is:

1. A signal processing apparatus for a stringed instrument comprising:

a low-pass filter that receives either one of a first signal acquired by picking up a vibration of a string and a second signal corresponding to an instrument sound including resonance of a body due to the vibration of the string, the first signal being a signal picked up by a vibration sensor mounted near a saddle supporting the string, and the second signal being a signal generated by a filter circuit that performs a convolution operation to the first signal;

a high-pass filter that receives the other one of the first signal and the second signal, and that has a cut-off frequency equal to or higher than a cut-off frequency of the low-pass filter; and a mixing unit that mixes the output from the low-pass filter and the output from the high-pass filter, and outputs the resultant.

2. The signal processing apparatus for a stringed instrument according to claim 1, wherein the cut-off frequency of the high-pass filter and the cut-off frequency of the low-pass filter are equal to each other.

3. The signal processing apparatus for a stringed instrument according to claim 1, wherein the cut-off frequency of the high-pass filter is higher than the cut-off frequency of the low-pass filter, and the difference between both cut-off frequencies is set to be a small predetermined value.

4. The signal processing apparatus for a stringed instrument according to claim 1, wherein the low-pass filter receives the first signal, and the high-pass filter receives the second signal.

5. The signal processing apparatus for a stringed instrument according to claim 1, further comprising:

a change control unit that simultaneously changes the cut-off frequency of the low-pass filter and the cut-off frequency of the high-pass filter.

6. The signal processing apparatus for a stringed instrument according to claim 5, wherein the change control unit simultaneously changes the cut-off frequency of the low-pass filter and the cut-off frequency of the high-pass filter according to an operation on an operation unit.

7. A signal processing apparatus for a stringed instrument comprising:

a low-pass filter that receives either one of a first signal acquired by picking up a vibration of a string and a second signal corresponding to an instrument sound including resonance of a body due to the vibration of the string;

a high-pass filter that receives the other one of the first signal and the second signal, and that has a cut-off frequency higher than a cut-off frequency of the low-pass filter, a difference between both cut-off frequencies being set to be a small predetermined value; and a mixing unit that mixes the output from the low-pass filter and the output from the high-pass filter, and outputs the resultant.

8. The signal processing apparatus for a stringed instrument according to claim 7, wherein the first signal is a signal picked up by a vibration sensor mounted near a saddle supporting the string, and the second signal is a signal picked up by a second vibration sensor mounted to the body or a signal acquired by a microphone mounted near the body.

9. The signal processing apparatus for a stringed instrument according to claim 7, wherein the low-pass filter receives the first signal, and the high-pass filter receives the second signal.

10. The signal processing apparatus for a stringed instrument according to claim 7, further comprising:

a change control unit that simultaneously changes the cut-off frequency of the low-pass filter and the cut-off frequency of the high-pass filter.

11. The signal processing apparatus for a stringed instrument according to claim 10, wherein the change control unit simultaneously changes the cut-off frequency of the low-pass filter and the cut-off frequency of the high-pass filter according to an operation on an operation unit.

12. A signal processing apparatus for a stringed instrument comprising:

a low-pass filter that receives either one of a first signal acquired by picking up a vibration of a string and a second signal corresponding to an instrument sound including resonance of a body due to the vibration of the string;

a high-pass filter that receives the other one of the first signal and the second signal, and that has a cut-off frequency equal to or higher than a cut-off frequency of the low-pass filter;

a change control unit that simultaneously changes the cut-off frequency of the low-pass filter and the cut-off frequency of the high-pass filter; and a mixing unit that mixes the output from the low-pass filter and the output from the high-pass filter, and outputs the resultant.

13. The signal processing apparatus for a stringed instrument according to claim 12, wherein the first signal is a signal picked up by a vibration sensor mounted near a saddle supporting the string, and the second signal is a signal picked up by a second vibration sensor mounted to the body or a signal acquired by a microphone mounted near the body.

14. The signal processing apparatus for a stringed instrument according to claim 12, wherein the cut-off frequency of the high-pass filter and the cut-off frequency of the low-pass filter are equal to each other.

15. The signal processing apparatus for a stringed instrument according to claim 12, wherein the low-pass filter receives the first signal, and the high-pass filter receives the second signal.

16. The signal processing apparatus for a stringed instrument according to claim 12, wherein the change control unit simultaneously changes the cut-off frequency of the low-pass filter and the cut-off frequency of the high-pass filter according to an operation on an operation unit.

* * * * *